United States Patent [19]

Broughton

[11] Patent Number: 5,066,036

[45] Date of Patent: Nov. 19, 1991

[54] SKI BINDING

[76] Inventor: Timothy C. Broughton, 135 Crestview La., Park City, Utah 84060

[21] Appl. No.: 496,436

[22] Filed: Mar. 19, 1990

[51] Int. Cl.[5] ..... A63C 9/86

[52] U.S. Cl. ..... 280/615; 280/613; 280/614; 280/618

[58] Field of Search ..... 280/613, 614, 615, 618, 280/620, 621

[56] References Cited

U.S. PATENT DOCUMENTS

| | | | |
|---|---|---|---|
| 3,865,388 | 2/1975 | Haldemann | 280/613 |
| 3,936,064 | 2/1976 | D'Alessio et al. | 280/618 |
| 4,172,602 | 10/1979 | Gertsch et al. | 280/618 |
| 4,273,355 | 6/1981 | Storandt | 280/618 |
| 4,915,406 | 4/1990 | Graillat | 280/615 |

*Primary Examiner*—Andres Kashnikow
*Assistant Examiner*—Eric Culbreth

[57] ABSTRACT

A ski binding system is adaptable to both alpine and cross-country/telemark skiing modes. A base plate is pivotably connected about a transverse axis to the boot by an upwardly extendable transduction hinge, at or just to the rear of the ball of a skier's foot, to provide torsional stability with either rigid or flexible-toed boots. The boot heel and point of connection may be freely raised from the binding. The base plate is safety releasable from the ski upon exertion of excess upward or transverse forces by the skier's foot.

23 Claims, 9 Drawing Sheets

SKI BINDING

BACKGROUND OF THE INVENTION

1. Field

This invention relates to ski bindings. More particularly, the invention relates to ski bindings which are adapted to be used for both downhill skiing and cross-country/telemark skiing.

2. State of the Art

Bindings for attaching boots to alpine, i.e., downhill skis have evolved from simple straps into which the boot is placed to complex safety bindings which rigidly clamp the boot to the ski. These safety bindings have apparatus which are set to release the boot at predetermined excessive forward and transverse forces.

On the other hand, cross-country and telemark skiing is performed with the heel of the boot free to rotate upward and forward during the skier's stride. Present bindings retain the toe of the boot sole in a rigid or semi-rigid position, and rely upon sole flexure to permit the boot to rotate about the toe. Alternately, the binding and the toe of the sole may rotate together.

The resurgence of telemark skiing over the past ten years has spurred an intensive developmental race for technological advancement of telemark ski equipment. In the late 1970's when "cross-country" skiers began telemarking on the slopes of lift serviced areas, new demands were made of the cross-country ski equipment available at the time. Numerous changes were made in the boot design to make it more like that of an alpine boot including a stiffer sole and thicker leather for better torsional control and a higher, stiffer cuff. This was the birth of a new sport: telemark skiing.

Over the past ten years, many skiers have turned to telemark skiing as an alternative to alpine skiing and in so doing have made new demands on their equipment. The ski industry responded by beefing up three-pin boots and bindings to support a more aggressive method of skiing. The three-pin system, originally intended to be used in cross-country skiing, was restructured for telemarking. This restructuring included placing stiff plastic cuffs and a stiffer sole in the boots and using stronger materials for the binding in an attempt to make the three-pin boot and binding system withstand the demands traditionally met by alpine skiing equipment.

There are several obvious advantages to using a telemark system which explain its recent rise in popularity in both the U.S. and Europe: (1) telemark equipment is very light weight, (2) it provides for a very efficient means of mobility with its flexible toe, and (3) it performs well for skiing downhill through powder snow. However, in the use of a conventional telemark system when skiing at lift serviced resort areas, where slopes are often icy or packed powder, or on dangerous ice clad slopes in an alpine environment, the three-pin telemark boot and binding system is entirely ineffective in holding an edge, when compared to a conventional alpine skiing system.

The three-pin binding is still held as the best system available when the advantage of having a flexible toed boot is desired for cross-country travel and telemark skiing. However, the problem with the three-pin system is that it is torsionally unresponsive to the skier, i.e., it has a certain amount of twist in the sole of the boot which makes it difficult to hold an edge on packed powder or icy slopes. Although the ski industry has made the boots stronger, higher, and more rigid with plastic inserts and improved structural characteristics, the fundamental design of the binding has not changed.

The growing number of telemark skiers that frequent lift-serviced alpine resorts or engage in "extreme skiing" are pushing to the limits of their abilities to meet the challenge of keeping up with the abilities of alpine skiers. In order for "tele-skiers" to exhibit comparable control to that of an alpine skier, there must be an overall change in the technology of telemark equipment.

Another form of cross-country/downhill touring system is the alpine touring binding which is designed to be used with rigid soled alpine boots. This style of touring is currently very popular in Europe. There are typically three major problems with the alpine touring bindings on the market today. First, the alpine touring binding is relatively heavy. Most of the alpine touring systems weigh close to five pounds per pair. Obviously, considerably more energy is required for the skier to make a touring ascent using a heavy binding than it does with a lightweight binding.

The second major problem with alpine touring systems is that they do not perform well in a cross-country mode. With the heel of the boot free, the binding provides very little resistance to raising the heel from the ski, which is fine for touring or walking on flat land or climbing a hill, but for skiing alpine style, down a steep face between the flat sections of a traverse, the absence of a substantial resistance to forward lean would increase the possibility of doing a "face plant" or worse. To avoid this, the skier would either have to stop and lock the heel of the boot down every time a downhill section was encountered or resort to using a telemark turn. Although telemark turning with alpine touring binding systems avoids the face plant problem, performing a telemark turn without the benefit of utilizing the flexible toe of a flexible-toed boot, and without any reasonable forward lean resistance provided by the binding, forces the skier to make turns on the tip of the toe instead of on the ball of the foot of the uphill ski. Telemark turning on the tip of the toe is awkward and unstable, resulting in an overall poor skiing performance which is less than desirable when confronted with a difficult traverse on top of a steep icy corniced ridge.

The third major problem with alpine touring bindings is related to the release capabilities of the bindings. Some alpine touring bindings require the skier to stop and take off the ski in order to change skiing modes, and some are not releasable in the touring mode. Others are releasable transversely at the heel which is more likely to cause skier injury than a binding that releases transversely at the toe.

In cross-country/telemark skiing, control of the skiis requires that torsional movement of the boot about the axis parallel with the ski is minimized so that each ski can be firmly directed by maintaining the desired rigidity between boot and ski. Bindings mounted at or forward of the toe permit undesirable torsional bending forces acting through the toe sections of the boot and transverse flex of the boot with respect to the ski axis.

In toe-connected boots, torsional rotative forces are transmitted from the skier's ankle through the length of the boot. The fixed toe acts as an axis of rotation, and the relatively long distance from ankle to toe is the radius of rotation. The torque exerted on the toe by a given transverse force F is the moment of inertia times angular acceleration. The moment of inertia is proportional to the square of the radius of rotation. The bending and twisting moments are absorbed primarily by the boot sole and may be very high, resulting in undesirable transverse flexure and torsional twisting about the longitudinal axis of the boot. Such flexure and twisting results in diminished control of the ski edges on the skiing surface.

The sport that telemarking has become today demands even more of its equipment including the need for the edge control capability of an alpine system along with the light weight, efficient mobility of a cross-country ski system. Despite all of the efforts made in the ski industry, the ultimate telemark system has yet to be developed.

SUMMARY OF THE INVENTION

The invention is a lightweight releasable ski binding that provides the torsional rigidity necessary for unsurpassed high performance telemark skiing without compromising the desirable aspects of efficient mobility utilizing the flex of the toe. This innovation is unique among all other telemark and alpine touring bindings in that it is truly a hybrid of both alpine and telemark skiing system: it provides the edge control of an alpine ski system and the efficient mobility of a cross-country ski system. This new hybrid binding system provides the vital link necessary for the advancement of the sport.

Probably the most innovative aspect of this hybrid binding is that it can also be used as an alpine touring system. It may be used with a flexible toed telemark boot or with a full plastic, rigid soled alpine touring boot. The heel of either boot can be releasably locked down for an alpine ski descent or left free to ski cross-country just as with any other alpine touring system. However, this new system has several significant improvements over the others. One notable improvement is that the new hybrid binding is lighter in weight than other alpine touring bindings currently available. A second important improvement is the new system's ability to function as a telemark system using a flexible-toed ski boot which is necessary for skiing cross-country in the most efficient manner possible. The utilization of a flexible-toed boot is necessary to enable the skier to tackle difficult terrain using a telemark technique while in transit, before reaching the final destination where the need for an alpine skiing technique is strongly desired. In alpine touring, the capability to ski with the highest level of performance possible is extremely critical during the touring portion of an expedition. The telemark/alpine hybrid binding of this invention provides the potential for the highest level of performance in confronting a tenuously steep touring situation because it provides the capability for performing state of the art telemark turns utilizing the flex of the toe. Telemark skiing with a flexible-toed boot is more superior than trying to telemark on standard alpine touring bindings with the heel free while in the mode of cross-country/touring.

The advantage of this new design, over the many various types of existing telemark and alpine-touring or randonee bindings is its ability to utilize the desirable aspects of a telemark skiing system while maintaining the edge-holding capability of an alpine skiing system in an ultra-lightweight releasable binding. This new binding allows the skier to walk in a manner that is naturally efficient (i.e., the ability to use a flexible-toed boot on which the skier is able to roll off the ball of his foot with each stride) while allowing the ability to execute telemark turns downhill without having to overcompensate for the boot's torsional and transverse deformation. In addition, the skier has the option of skiing with the heel releasably locked down for alpine skiing.

The most obvious benefit of using an alpine touring system is its ability to hold a strong edge and the ability to either free the heel of the boot for cross-country skiing (touring) or releasably lock the heel of the boot for skiing downhill. There are many binding systems available that releasably bind a ski boot, typically to a plate or rigid mounting surface which is fixed to the ski on a horizontal, transverse axis in front of the boot toe. The plate can be locked down for alpine skiing or allowed to pivot about the axis in front of the toe to allow the heel of a ski boot to come up for the purpose of walking. This type of system works well as an alpine binding but has some undesirable characteristics and problems as a touring system. The argument can be made that a telemark system is far superior to these types as a touring system, but as a downhill skiing system there is no comparison between the two. The binding system of this invention is designed to bridge the gap between the telemark and alpine touring systems and ultimately to outperform them both as an alpine/-telemark touring hybrid system.

The binding is comprised of several basic subsystems, including a boot guidance/connection mechanism which fits under the instep of the boot, a transverse release subsystem under and in front of the toe of the boot, a spring-actuated toe bail tensioning mechanism for clamping the toe of the boot to the ski, a cam-actuated heel return mechanism, a heel- or forward-safety release mechanism, and an optional heel clamp that clamps the heel down with respect to the binding. The forward safety release mechanism fits under the instep of a ski boot and allows the entire guidance/connection mechanism and forward safety release mechanism to release from the ski and remain attached to the boot.

The binding is pivotally and releasably connected to the boot at a point which is at or somewhat rearward of the ball of the skier's foot. By making the connection at this point, the transverse and longitudinal twisting of the sole is greatly reduced. At this point, the sole of modern boots is much more rigid than the area of the sole forward of the ball of the boot. Thus, ski control under both normal and highly stressed conditions is enhanced.

Use of this binding permits a skier to use a single boot/ski combination in both the "downhill" or "alpine" mode and in the "cross-country/telemark" mode.

The binding enhances ski control, particularly in the "cross-country/telemark" mode, by limiting the torsional and transverse flexure in the boot and enhances greater efficiency in cross-country mobility. The binding is adaptable to rigid "downhill" boots, non-rigid "cross-country" boots or rigid boots having a flexible toe section.

DESCRIPTION OF THE PREFERRED EMBODIMENTS

The various features of the binding of this invention are more readily defined with reference to the drawings.

Figure 1:
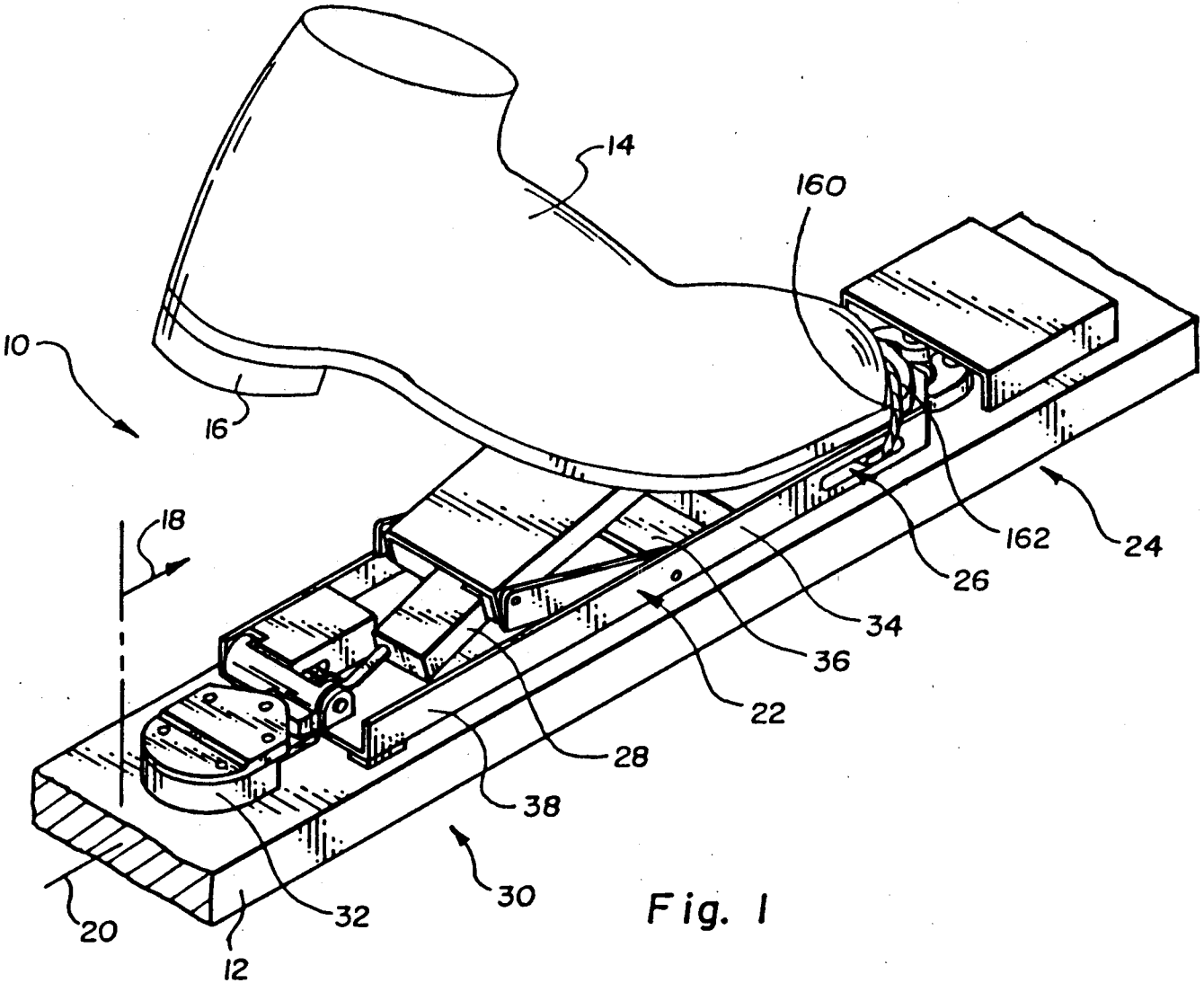
FIG. 1 is a perspective view of the ski binding system of this invention, in which the boot and binding are in a "cross-country" or "liftable heel" mode.

FIG. 1 shows the ski binding system 10 releasably attached to a ski 12 and a ski boot 14. The binding system 10 is in a "non-rigid" or "cross-country" mode where the boot heel 16 is movable in a vertical plane 18 passing through the longitudinal axis 20 of the ski 12.

The subsystems of the binding system 10 as shown in FIG. 1 include a boot guidance/connection mechanism 22, a transverse release subsystem 24, a toe bail tensioning mechanism 26, a cam actuated heel return mechanism 28, and a heel- or forward-safety release mechanism 30. A heel clamp, not shown, may optionally be used to hold the boot heel 16 down against the binding heel 32 during skiing in the alpine mode. Such heel clamps are known in the art.

The subsystems cooperate to provide an improved binding system for both downhill, i.e., alpine skiing and cross-country/telemark skiing.

Major portions of the boot guidance/connection mechanism 22, transverse release subsystem 24, toe bail tensioning mechanism 26, cam actuated heel return mechanism 28, and forward safety release mechanism 30 are mounted on an elongate base plate 34 which has a generally flat inner surface 36 with narrow upright sidewalls 38. Base plate 34 comprises a platform for the boot and is retained on ski 12 by ski mounted portions of the transverse release subsystem 24 and the heel- or forward-safety release mechanism 30. The base plate 34 remains attached to boot 14 until excess forward or transverse forces trip subsystem 24 or mechanism 30 to release the base plate and apparatus mounted thereon from the ski.

Figure 2:
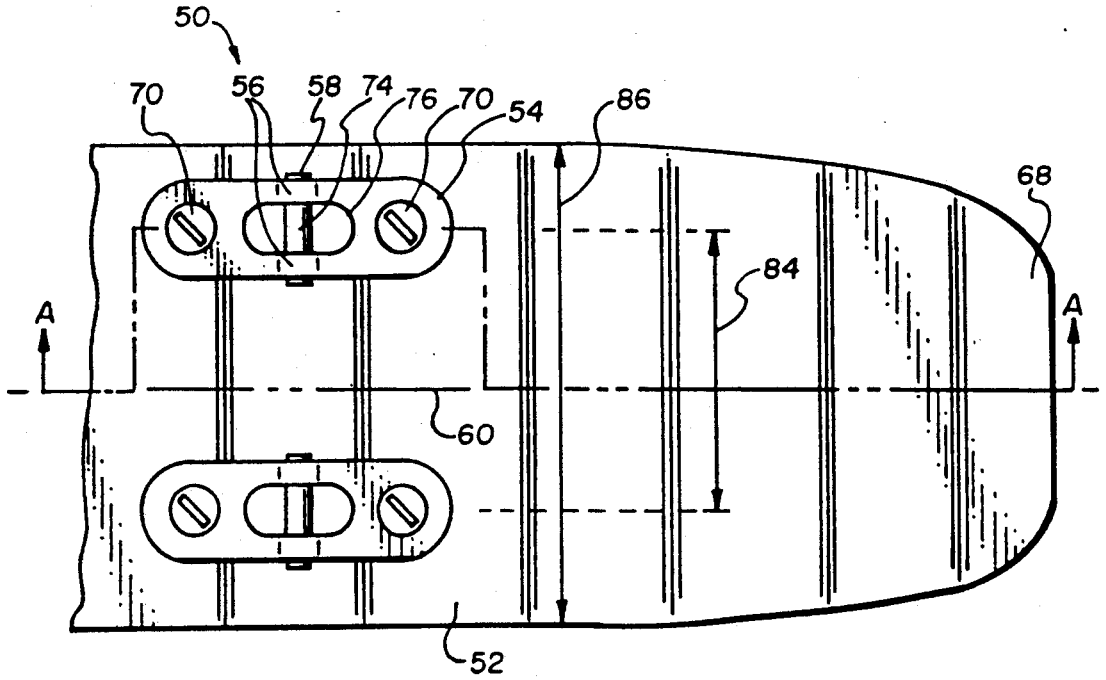
FIG. 2 is a bottom view of a ski boot showing the means for connecting the boot to a ski.
Figure 3:
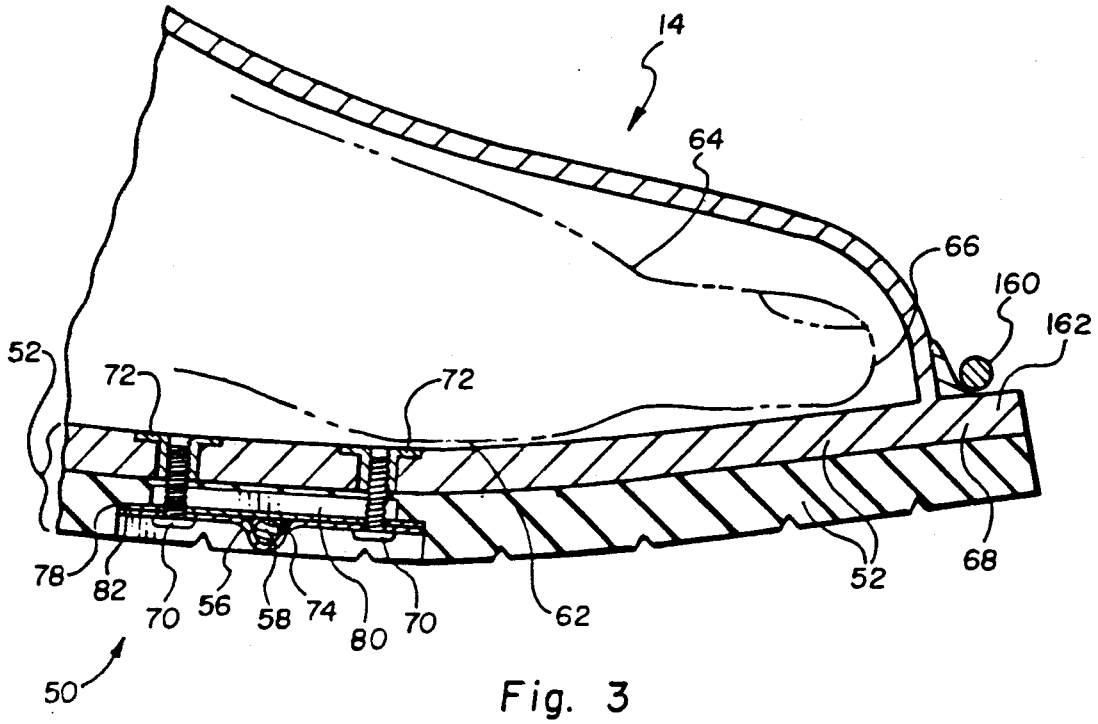
FIG. 3 is a sectional side view of the sole of FIG. 2 and attached upper of the boot, showing the means for connecting the boot to a ski.

FIGS. 2 and 3 depict a typical non-rigid or "cross-country/telemark" ski boot 14 with attachment means 50 fixed to the sole 52. Means 50 includes one or more boot plates 54, each having holding means 56 for a transverse axle 58 fixed across an opening 76 in the boot plate 54. The axle 58 is aligned perpendicular to the longitudinal axis 60 of the boot 14, at or just rearward of the ball 62 of the skier's foot 64 shown in phantom. This location is typically about 25 to 50 percent of the distance from the toe 66 to the heel, not shown, of the skier's foot 64. This is in contrast to prior art cross-country binding systems in which only the toe 68 of the boot 14 is clamped in a relatively stationary position on the ski.

The boot plate 54 may be made of a base 78 with side panels 80, to which is welded or otherwise joined a cover 82 centrally raised, bent, or otherwise formed to provide holding means 56 for axle 58.

Each boot plate 54 is shown with two screws 70 and tee connectors 72 which pass through boot sole 52 for rigid attachment of the plate to the sole. A roller 74 spans the opening 76 in the plate 54, being mounted on the axle 58.

In order to avoid the concentration of twisting and transversely acting forces in a localized area of the boot 14, the boot plates 54 are spaced laterally a distance 84 to distribute such forces over a major portion of the sole width 86.

The side panels 80 and preferably the base 78 and cover 82 as well, are set into the sole 52 to permit use of the boot when not skiing. A portion of sole 52 immediately above the plate opening 76 is removed or deleted to permit easy insertion of jaw hooks, not shown, around the roller 74 for attachment of the boot 14 to the ski.

Toe bail 160 is also shown on toe portion 68, preventing appreciable forward, transverse, and upward movement of the toe.

Figure 4:
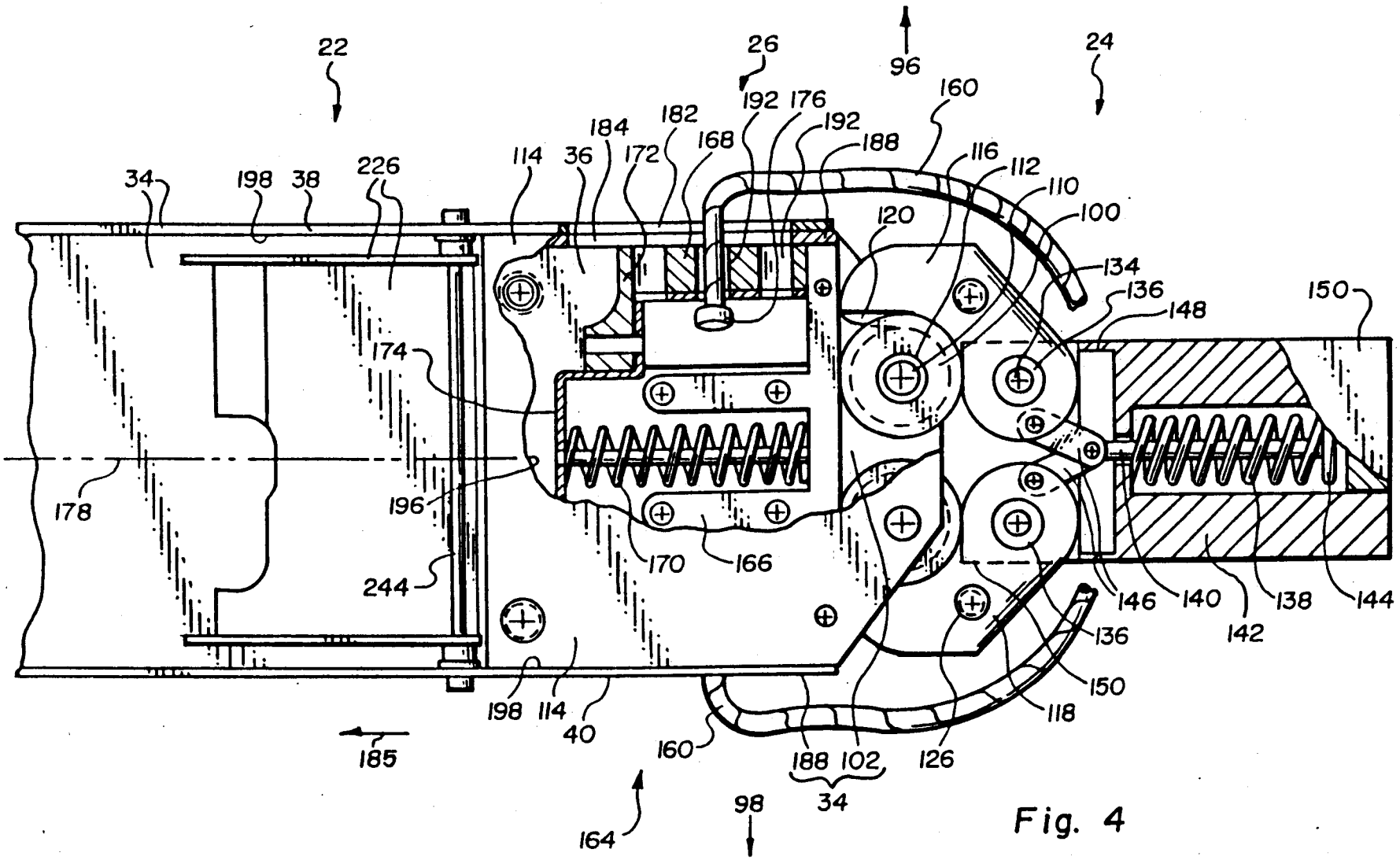
FIG. 4 is a partially cutaway plan view of the forward portion of the ski binding of the invention.

FIG. 4 is a plan view of the forward portion of the binding system, and includes partial cutaway views of the transverse release subsystem 24 and toe bail tensioning mechanism 26, as well as portions of the boot guidance/connection mechanism 22. It is understood that in FIG. 4, as in other figures, as normally viewed, the front tip of the ski is to the right.

The transverse release subsystem 24 is a step-in type of toe release which normally prevents forward, vertical, or transverse movement of the base plate 34 and apparatus attached thereto, relative to the ski. Spring tension acting on two opposed levers 116 and 118 is preset to permit excessive transverse forces to move one or more of the levers outwardly to release the base plate 34. Thus, possibility of injury to the skier in an accident is much reduced.

Figure 9:
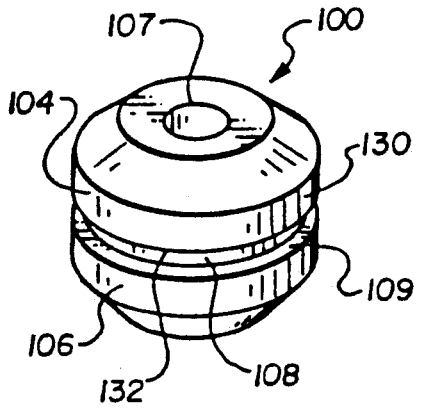
FIG. 9 is a perspective view of an embodiment of the transverse release roller of the invention.

The transverse release subsystem 24 is designed to release the base plate 34 when excessive transverse forces are applied in direction 96 or 98. It includes two transverse release rollers 100 mounted on a forward extension 102 of the base plate 34. As shown in greater detail by comparing FIG. 4 and FIG. 9, roller 100 may be formed of circular upper and lower washers 104 and 106 respectively, with a middle spacer 108 of smaller diameter sandwiched between the washers. The result is a circular roller with a circumferential groove 109. The assembly is attached to the base plate 34 through hole 107 by screw 110, and a roller bushing 112 permits the roller to freely rotate about the screw. Preferably, a substantial portion of the rollers is covered by toe bail mechanism cover plate 114, the latter acting as a base for the skier's boot 14.

Figure 10:
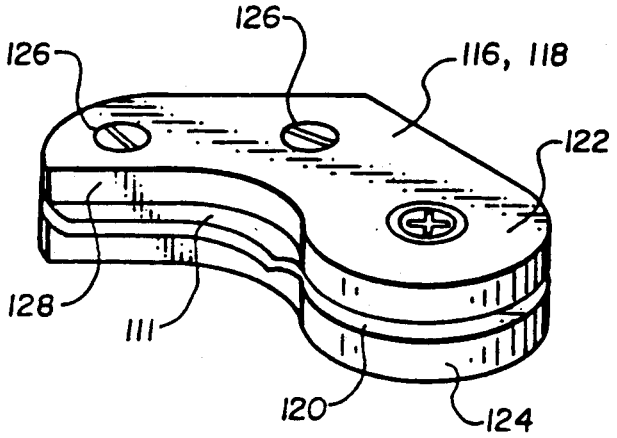
FIG. 10 is a perspective view of an embodiment of the release roller lever of the invention.

As shown in FIG. 4, subsystem 24 also includes a pair of transverse release levers 116 and 118. For purposes of discussion, lever 116 will be designated as an inner lever because it is located adjacent the inside of the skier's foot, while lever 118 will be designated as the outer lever. The levers may be formed, as shown in FIG. 10 and FIG. 4, of a hard metallic gripping layer 120 sandwiched between upper and lower lever layers 122 and 124, respectively. The layers in each lever are preferably joined by a screw 126 or other means to form each lever 116, 118 as an integral unit. The inner circular surface 128 of each lever corresponds to the shape of the perimeter 130 of the rollers 100. The gripping layer 120 of each lever 116, 118 is shaped to fit in groove 109 and projects from the lever in contact area 111 to normally insert and lodge against the middle spacer 108 over about one-fourth of the perimeter 132 of the spacer 108.

Optionally, each roller may be molded or machined as one piece with groove 109 integrally formed therein. Likewise, each lever may be formed of a single piece of hard metal.

The levers 116, 118 are joined to the ski by screws 134 which pass through bushings 136. The levers rotate or pivot about the bushings 136 in a normally horizontal plane, and are biased by transverse release spring 138 to grip the rollers 100. Spring 138 is mounted on transverse release spring rod 140 and held at a set tension within spring housing 142 by the adjustment of spring adjustment nut 144 on rod 140. Each lever 116, 118 is pivotably joined to rod 140 by a lever rod link 146.

In the embodiment shown in FIG. 4, the spring housing 142 includes a rearward wall extension 148 to proximate the levers, thus preventing the accumulation of snow or ice between the levers. Furthermore, a transverse release top cover 150 covers the spring housing 142 and adjacent portions of the levers, to keep them generally free of snow and ice.

An important feature of this invention is a spring-loaded contractible toe bail 160. The bail is a cable, rigid rod, or other means which passes around the toe and over a forward extension or welt lip 162 of the boot sole to hold the toe of the boot in place. See FIG. 3.

When the binding is used to secure a flexible-toed boot for telemark/cross-country skiing, upward boot flexure foreshortens the effective boot length. Such boots often have a relatively small welt lip on the toe sole, and the bail may disengage from the lip unless it is biased rearward to maintain pressure on the toe during such foreshortening.

A toe bail tensioning mechanism 26 is symmetrically positioned about longitudinal centerline 178 in the front portion 164 of the base plate 34, on flat surface 36 between sidewalls 38 and 40 and to the rear of front end closure 166. A spring-loaded sliding block assembly 168 is biased rearward of closure 166 by toe bail traction spring 170. As shown in FIG. 4, the sliding block assembly 168 may be constructed of two toe bail traction blocks 172 and connected by a toe bail block frame 174 which fits in slots 171 in each block, to form a means to bias the bail 160 rearward. The ends 176 of bail 160 are connected through longitudinal slots 182 and 184, and through holes 192, and attached to the respective toe bail traction blocks 172. The bail ends may be swaged or otherwise formed so that they may be passed through asymmetrical holes 192 in the bail blocks and then turned to be locked in place.

The whole toe bail tensioning assembly 26 is biased by a toe bail traction spring 170 to slide rearward in direction 185 and maintain tension on toe bail 160. A toe bail mechanism cover plate 114 is attached to the base plate 34 and front end closure 166 to enclose the assembly 26. Cover plate 114 also covers a major portion of the transverse release rollers 100, and provides a support for the front portion 68 of the boot sole 52. In this embodiment, cover plate 114 is shown with supportive sidewalls 188, having slots 184 therein for passage of bail ends 176, 178 therethrough.

Figure 11:
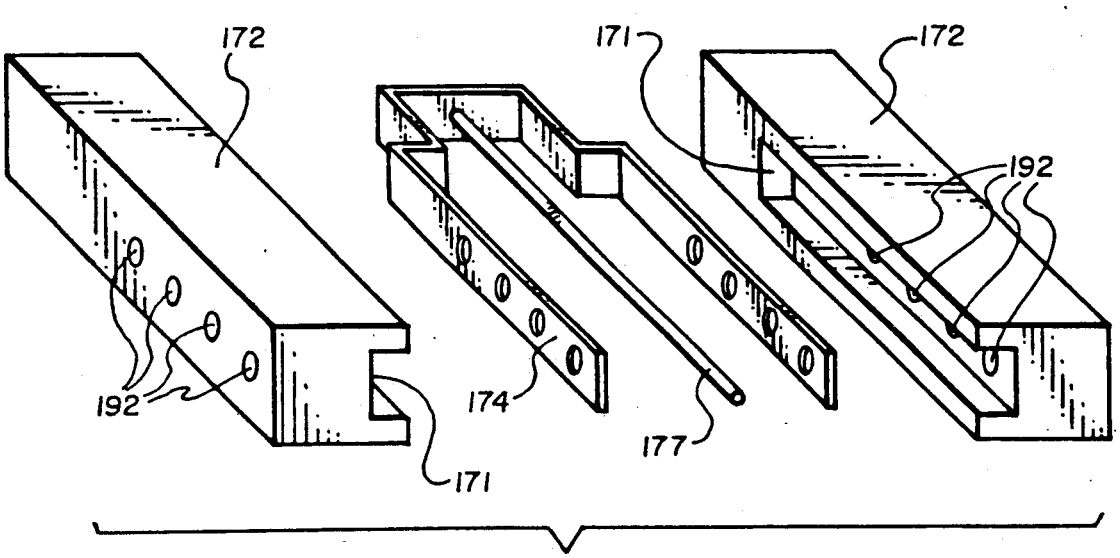
FIG. 11 is a perspective view of one embodiment of the traction block assembly of this invention.

Traction blocks 172 may be formed of metal or plastic with low coefficient of friction, such as a fluorocarbon. As shown in FIGS. 4 and 11, each block 172 has several holes 192 for alternate attachment to bail 160, and for weight reduction. Blocks 172 are joined by block frame 174 and slide between the upper surface 36 of base plate 34, the lower surface 196 of cover plate 114 and the inner surfaces 198 of the sidewalls 38, 40 of base plate 34. Frame 174 is shown with spring guide 177 for retaining spring 170.

Rearward of the toe bail assembly 26 is shown a transduction hinge 226. The hinge is pivotably attached to the base plate 34 by a first hinge axle 244.

The boot guidance/connection mechanism 22 provides the means by which the boot is connected to the binding and functions as a guidance mechanism which follows the natural motion of a flexible or rigid toed ski boot. As already described in relation to FIG. 3, the boot-to-binding connection is to be made under the sole of a ski boot at a location that is just behind the ball of the foot. Since telemark ski boots are flexible at the toe and rigid from the ball of the foot to the heel, the binding is connected to the boot behind the ball of the foot instead of at the toe as with conventional telemark binding systems. By locating the boot-to-binding connection to a rigid part of the boot behind the ball of the foot, the torsional properties and edge holding capability of the entire ski-boot-binding system is greatly improved. All other known telemark ski systems make their connection at the toe, i.e., to a flexible part of the boot which results in poor edge holding characteristics.

Figure 5:
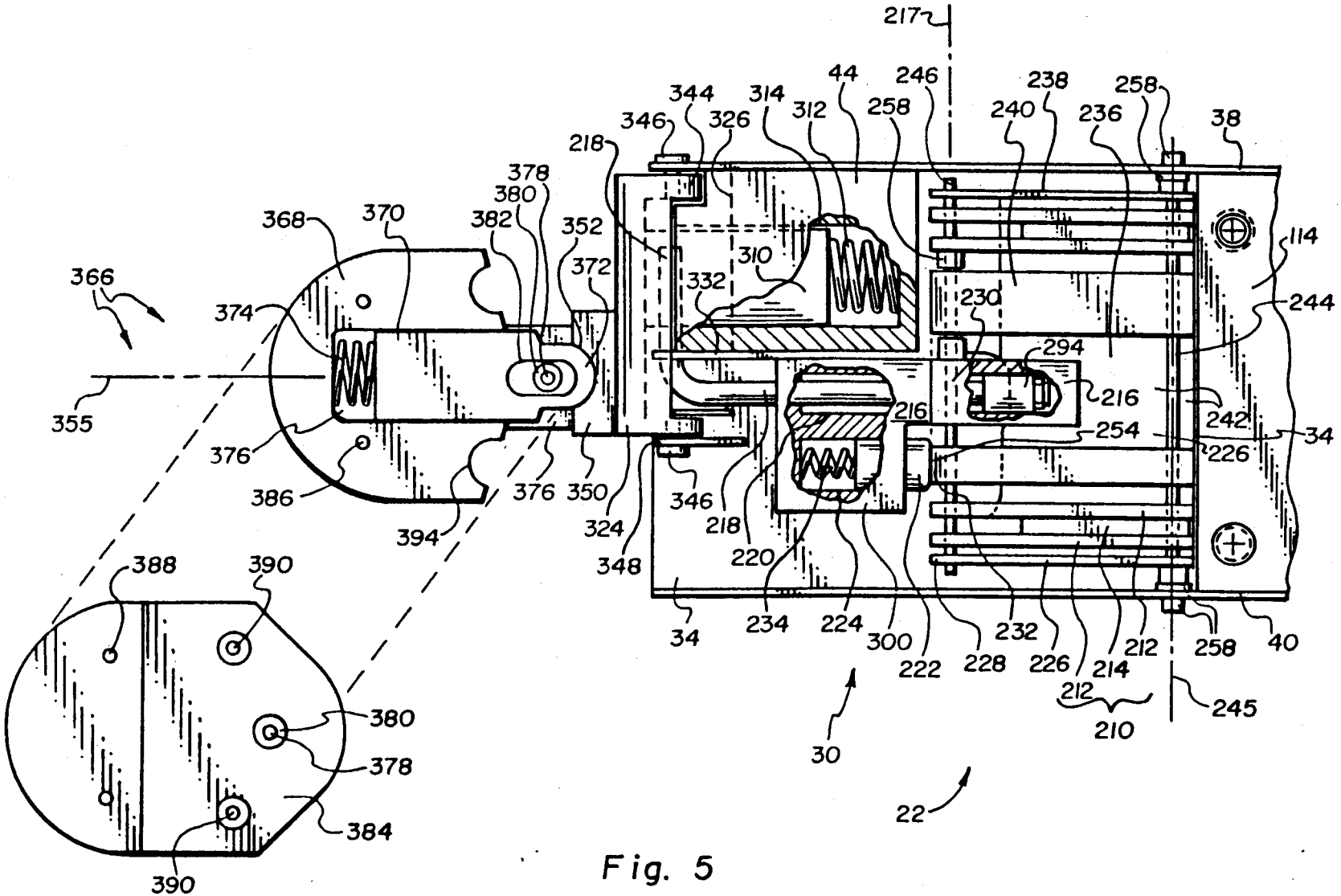
FIG. 5 is a partially cutaway plan view of the rearward portion of the ski binding of the invention.
Figure 12:
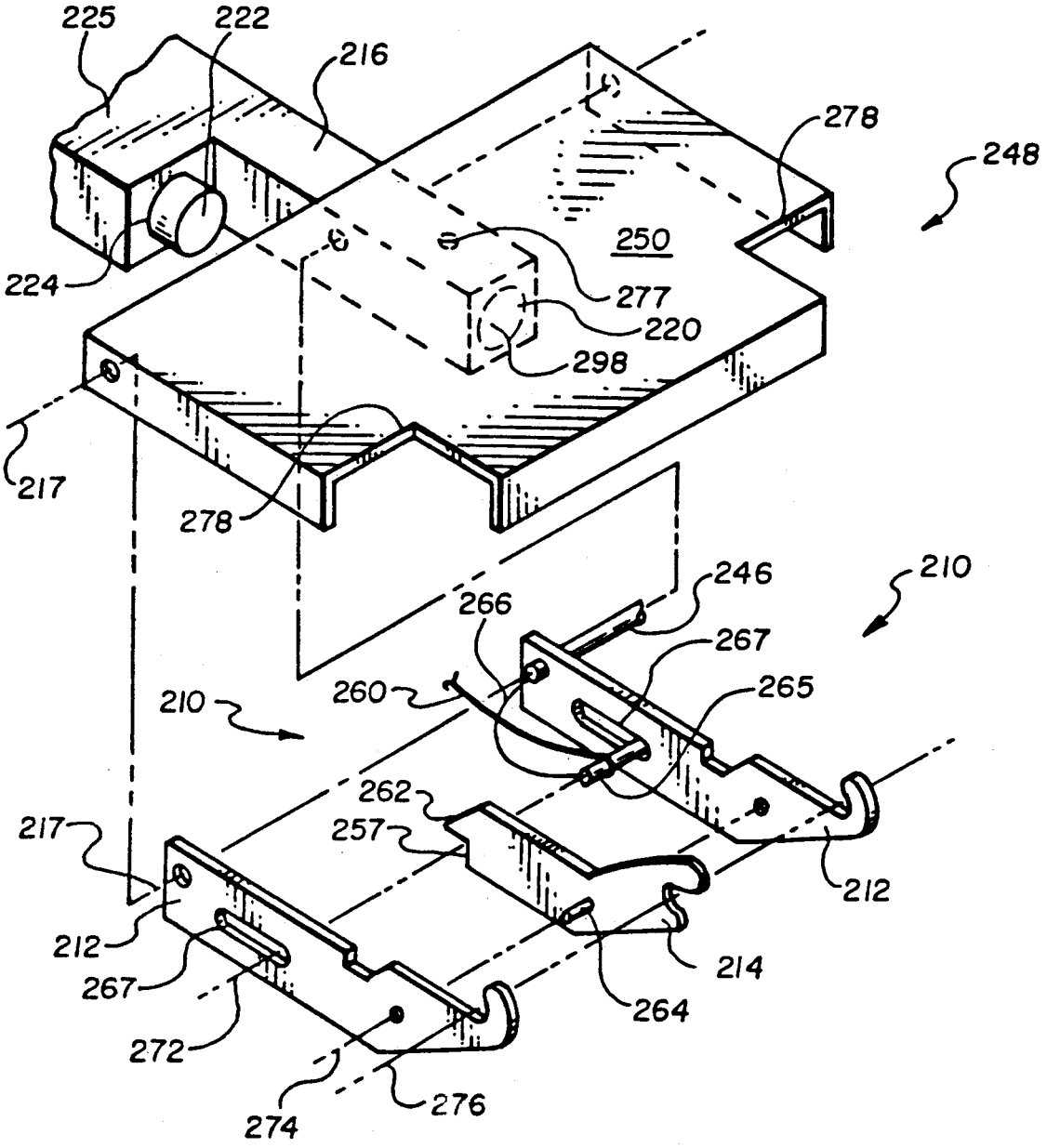
FIG. 12 is an exploded perspective view of an embodiment of one of the sets of clasp closure sets and the platform to which it is attached.

As shown in the plan view of FIG. 5 and the detailed view in FIG. 12, the boot guidance/connection mechanism 22 includes two or more sets of clasp closures 210, each set comprising two clasp arm hook jaws 212 with a pivotable closure jaw 214 sandwiched therebetween. Also included is an elongate guide bar housing 216 which encloses a slidably movable guide bar 218 in a lengthwise cylindrical bore 220, and a spring-loaded heel lift resistance spring sleeve 222 in a heel return spring housing bore 224. The boot guidance/connection mechanism 22 also includes a transduction hinge 226 which at its rear end 228 is pivotally connected to the generally central portion 230 of the guide bar housing 216, along axis 217, and at the opposite end is pivotally connected to the base plate 34, the latter being held to the ski at its front and rear ends by the transverse release subsystem 24 and heel safety release mechanism 30. A cam-shaped transduction hinge block 232 on the hinge is motivated by the heel lift resistance spring 234 acting on heel lift resistance spring sleeve 222 to provide resistance to movement of the transduction hinge 226 and bias the hinge and attached boot toward a lower position adjacent the ski.

In the embodiment shown in FIG. 5, the transduction hinge 226 has a generally flat surface 236 and sidewalls 238. Fixedly attached to the hinge are a left transduction hinge block 240 and a right transduction hinge block 232. The forward end 242 of hinge 226 is mounted on first hinge axle 244 to pivot relative to the base plate 34 along axis 245.

At the rear end of transduction hinge 226, a second hinge axle 246 passes through hinge sidewalls 238 and hinge blocks 232 and 240. Mounted on the second axle 246 to pivot from the transduction hinge 226 is an attachment assembly 248 comprising a platform 250, as shown in FIG. 12, to which is joined the clasp closures 210 so that they will readily slip into the previously described boot plates 54 for attaching the boot 14 to the binding system 10.

Figure 13:
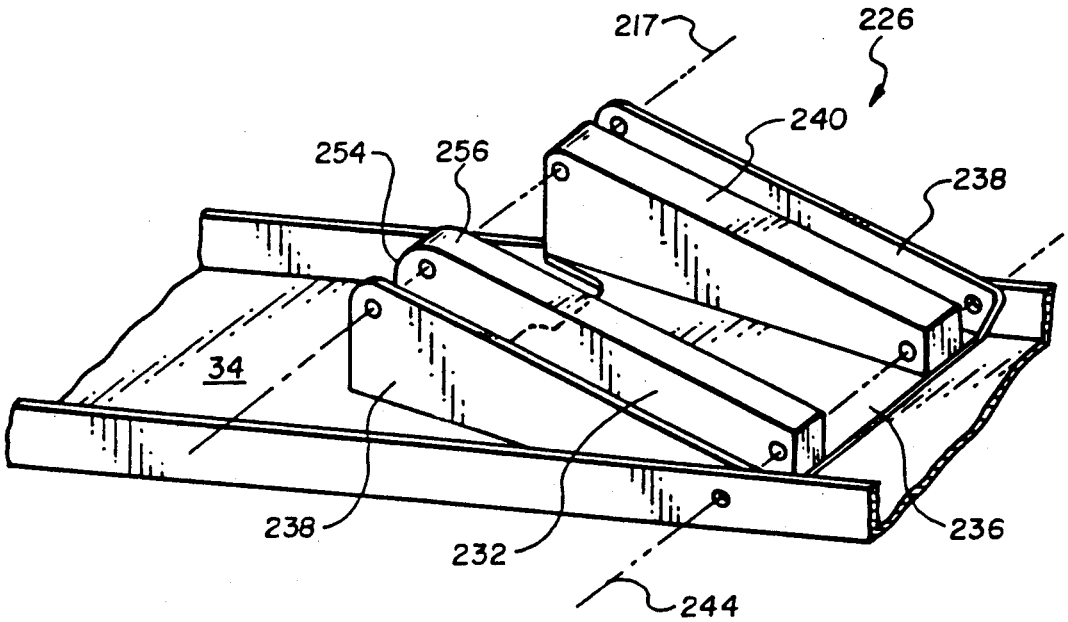
FIG. 13 is a perspective view of the transduction hinge assembly of the invention.

In conjunction with FIG. 5, FIGS. 12 and 13 illustrate the parts and assembly of an embodiment of the transduction hinge 226 and attachment assembly 248.

Transduction hinge 226 with flat surface 236 and hinge sidewalls 238 is shown as pivotable relative to the base plate 34 about first axle 244. Bushings 258 provide the desired spacing to ensure free pivotal movement of the hinge.

Transduction hinge blocks 232 and 240 are shown rigidly attached to the hinge 226. Hinge block 232 has a cam surface 254 on its rear end which is acted upon by spring-actuated sleeve 222.

As shown in FIG. 12, clamp closures 210 are located along each side of the platform 250. Each comprises a pair of laterally spaced outer or clasp arm hook jaws 212 fixedly attached to each side of platform 250, and a closure jaw 214 pivotedly mounted therebetween on jaw axle 264. Jaw closure shear spring 266 is mounted on second axle 246 and locking pin 265, which slides in slots 267 in the outer jaws 212. Spring 266 biases pin 265 forward into notch 257 to lock the jaws shut. Spring 266 acts to maintain the closure jaw 214 in a locked shut position. It is manually openable by manipulating cable pull release 260 for detachment from the boot. When open, the closure jaw is maintained in that position. The jaw 214 has an angled surface 262 which opens the spring-biased locking pin 265 upon insertion of axle 58 into the jaws. When pin 265 is retracted by pulling on cable pull release 260, closure jaw 214 opens by the force of gravity. The boot-to-binding connection is made by the jaws 212, which grasp the boot plate roller 74, and by closure jaw 214, which rotates about axle 264 to lock and secure clamp closure 210 to the boot plate 54.

The assembly of the jaw subassemblies include alignment along second hinge axle 246, i.e. axis 217, slidable locking pin axis 272, jaw axle 264 along axis 274, and jaw axis 276.

Guide bar housing 216 is also attached to platform 250. Its position determines the upward angle of platform 250 from transduction hinge 226, not shown.

Platform 250 has mounted beneath it, by means of axle 246 and screw 277, the guide bar housing 216 and heel return spring housing 225. Guide bar housing 216 carries the guide bar 218 in cylindrical bore 220, and the heel return spring housing carries the spring-actuated spring sleeve 222 in bore 224.

Each clasp closure assembly is mounted in platform 250 so that the jaw axis 276 is above the forward end of the platform for ease of attachment to the boot plates 54. Each forward corner 278 of the platform is cut out to permit the pivotable closure jaw 214 to rotate.

Figure 14:
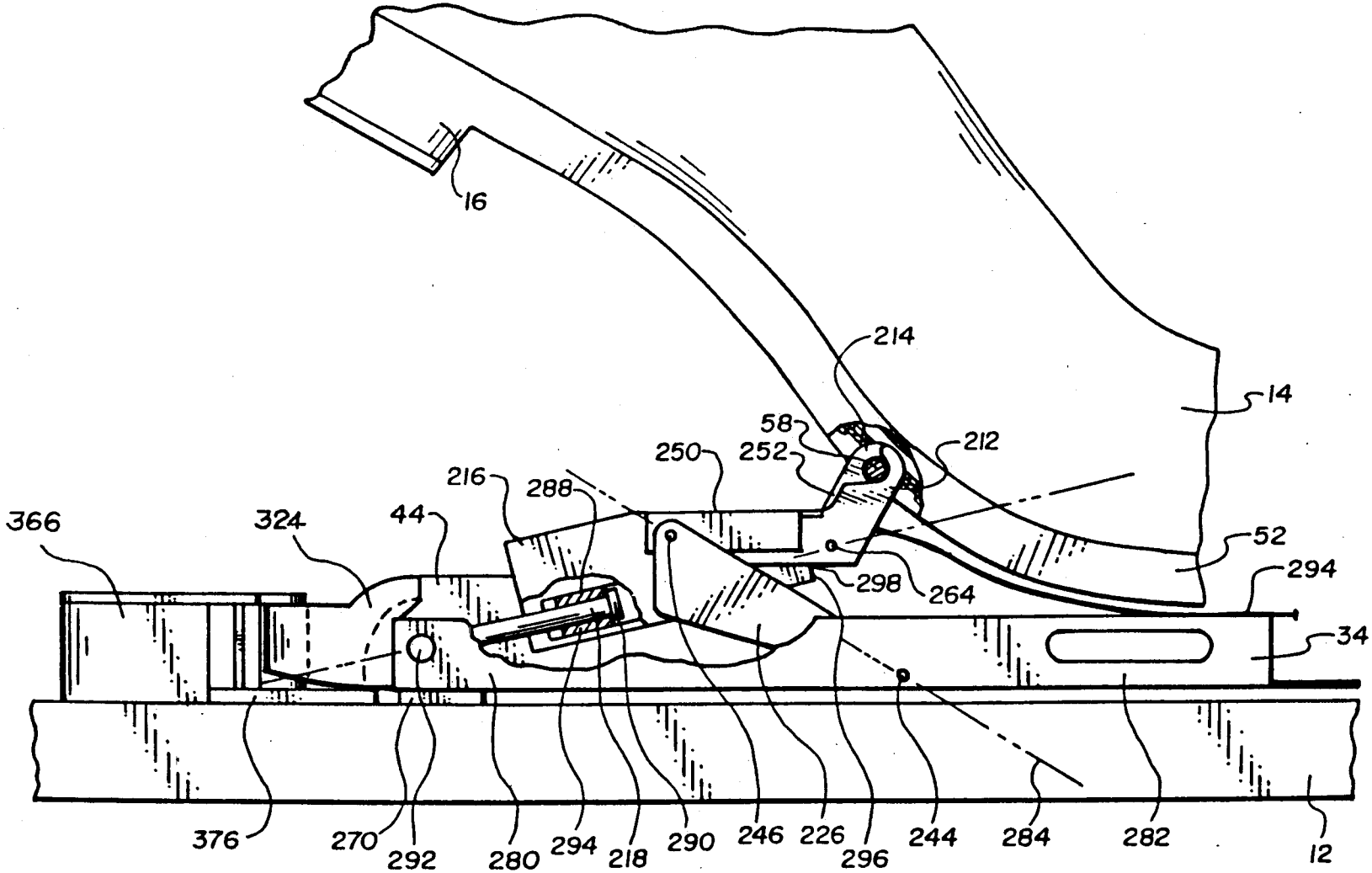
FIG. 14 is a partially cutaway side view of a ski boot with uplifted heel in the binding system of the invention.

FIG. 14 is a cutaway side view of the binding system illustrating a boot 14 with an uplifted heel 16. The base plate 34 is shown mounted on the ski 12, resting at its rear end 280 on a support shim 270 and the forward release spring housing, not visible, and at its front end 282 held by the transverse release subsystem 24, not shown in this drawing.

The major moving parts are the transduction hinge 226, the guide bar housing 216, and platform 250 with jaw assemblies 252. Guide bar 218 passes through a longitudinal cylindrical bore 288 in the housing 216, and has mounted on its forward end an end cap 290 which slides in bore 288. The rear end of the guide bar 218 is bent 90 degrees and is normally held at position 292.

When the boot heel 16 is down, axis 284 intersecting the first and second axles 244 and 246 is generally parallel with the ski 12.

Upward pressure on boot heel 16 raises the platform 250 and connected hinge 226. The path taken by the jaws very closely follows the path of the boot plate axles 58 as the boot sole bends and the boot 14 is effectively shortened in length. As a result, the boot is easily raised and dropped without undue stress on the binding mechanism.

Preferably, the front opening 296 of bore 288 is generally closed with plug means 298 to prevent snow from entering.

Also shown in FIG. 14 is a slip member 294 of Teflon or similar material. It underlies the sole of the boot and permits the boot 14 to slip backward to its natural position as the boot heel 16 is lowered after each step. This also reduces the stress on the guide bar 218 and housing 216.

The guide bar housing 216 is shown in FIG. 5 as integrally including a heel lift resistance housing 300 with bore 224 in which heel lift resistance spring 234 acts on spring sleeve 222 to communicate with transduction hinge block 232 as previously described.

Figure 6:
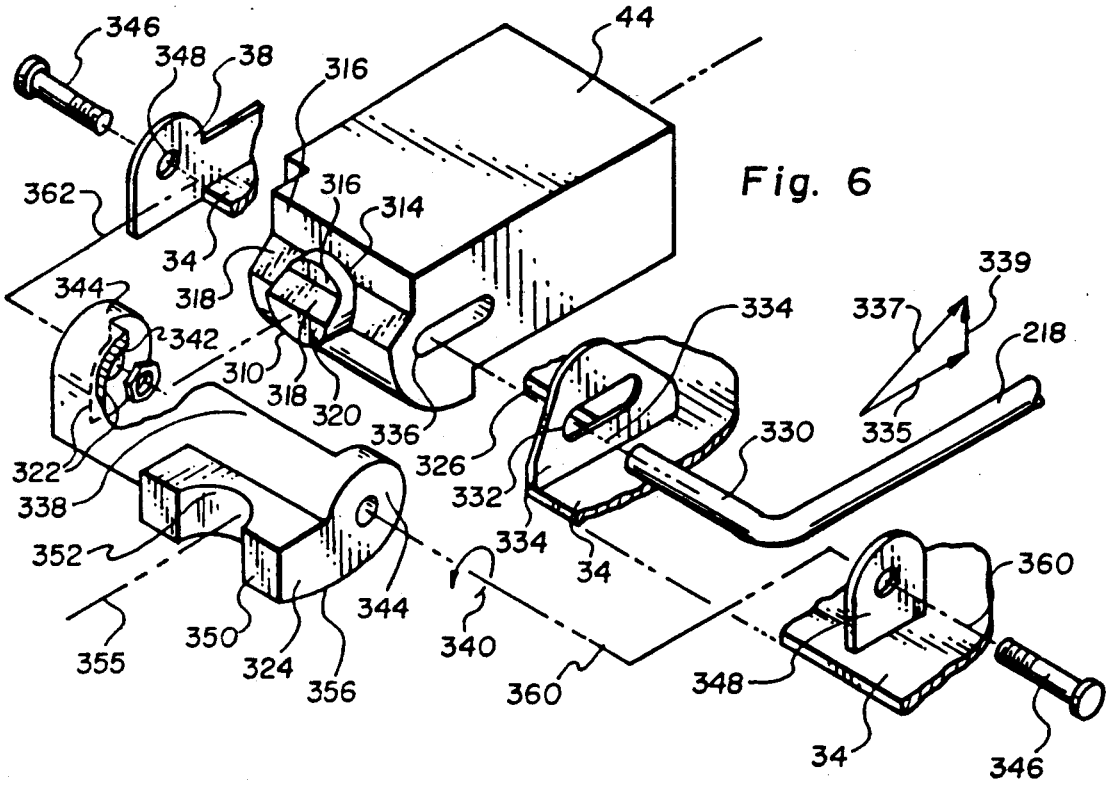
FIG. 6 is a perspective view of an embodiment of a portion of the forward safety release mechanism and forward release cam of the invention.
Figure 7:
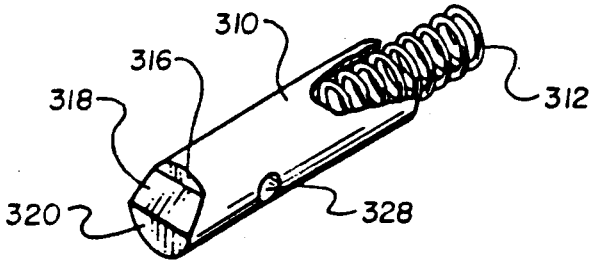
FIG. 7 is a perspective view of the forward release spring sleeve of the invention.

Turning to FIGS. 5-7, the forward or heel safety release mechanism 30 will be described in detail. Forward release spring housing 44 is fixedly mounted in base plate 34 as shown in the drawings. The rear portion of housing 44 extends downwardly past the rear edge 326 of base plate 34 to provide support for the base plate on the ski, and to strengthen the housing 44 against forward forces exerted by cam 324. A forward release spring sleeve 310 and spring 312 are mounted in rearward facing bore 314 in housing 44. The spring-actuated sleeve 310 has exposed end surfaces 316, 318 and 320 Which engage the internal forward surface 322 of forward release cam 324 to hold the cam in a stationary locked position as shown in FIG. 6.

The spring sleeve 310 also has an aperture 328 into which the rear end 330 of guide bar 218 is mounted. The guide bar 218 passes through a slot 332 in bar retainer 334 and a slot 336 in housing 44, so that forward movement in direction 335 by the guide bar 218 will move the sleeve 310 forward to reduce its pressure on cam 324, and allow disengagement of the sleeve 310 from the cam 324. As the skier's boot heel is moved upwards, the forward end of the guide bar 218 follows, so that the force on the guide bar is in direction 337 with a vertical component 339. The cam will then pivot in direction 340 and the base plate 34 will move upward to be released.

Forward release cam 324 has a central section 338 with a cam surface 322 on its inner normally forward side 342. The cam has two end plates 344 which are rotatably attached by a rivet, screw or other means 346 to base plate sidewall 38 and to one or more upright cam attachment means 348 mounted on the base plate 34. A rearward extension 350 of the cam has a circular recess 352 into which fits a spring-actuated member 354 to be described in relation to FIG. 8. The recess is located on or near the longitudinal centerline 355 of the binding system. The lower surface 356 of extension 350 is so shaped that as cam 324 is rotated in direction 340, about axis 360, the base plate 34 and parts attached thereto, including the cam 324 is pulled upward away from the ski by the vertical force of component 339. The upward movement compensates for the downward thrust of the rearward cam extension 350 so that disengagement of the base plate 34 from the ski is readily accomplished.

Preferably, the axis of rotation 360 of the cam 324 and the normal axis 362 of the rear end 330 of the guide bar 218 lie along the same line, perpendicular to the longitudinal axis 355 of the binder and ski.

Figure 8:
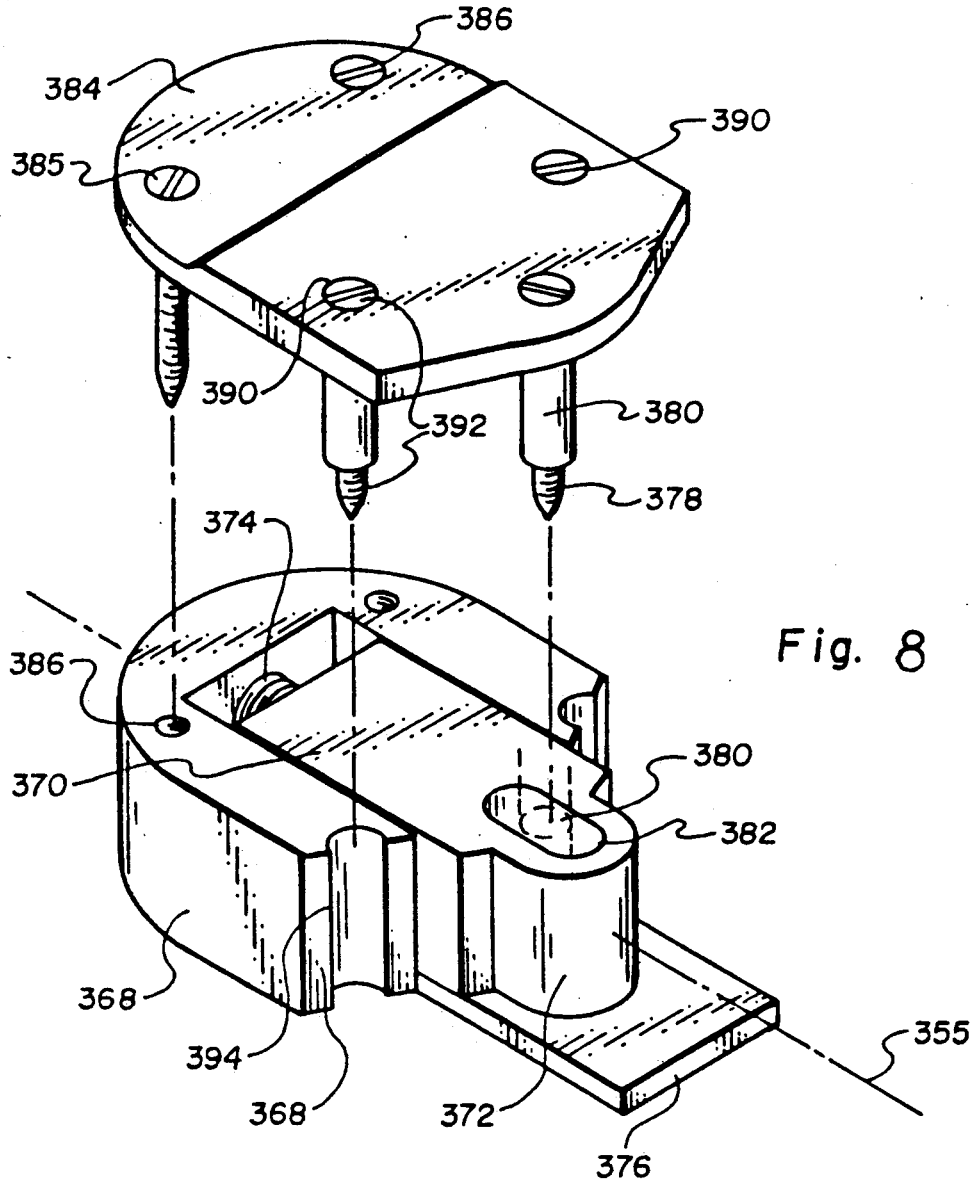
FIG. 8 is a perspective view of the heel assembly of the binding of the invention.

The heel safety release mechanism 30 also includes a ski-mounted heel assembly 366 which is illustrated in FIGS. 5 and 8. The heel assembly includes a heel piece body 368 including a sliding stud block 370 with a circular forward end projection 372. The projection 372 is biased by heel piece spring 374 to be mated into the circular recess 352 in the rearward extension 350 of cam 324. Stud block 370 slides on heel piece slip plate 376 which is part of the heel piece body 368. Sufficient forward force is exerted by spring 374 to hold the cam 324 in place during normal skiing The stud block 370 moves in response to ski flexure which alternately foreshortens and lengthens the top surface of the ski, thereby compensating for ski flexure which in other binding systems may result in disengagement or ski flex dampening.

In the illustrated embodiment, movement of the stud block 370 is limited to avoid loss of the block upon disengagement and to ensure that the proper tension of spring 374 is achieved. A center stand 380 is mounted on a screw 378 and fixedly attached to the ski thereby, through slot 382 in the stub block.

The heel piece body 368 and stud block 370 are covered by a protective heel cover 384, and the entire heel assembly 366 mounted to a ski with screws 385 through holes 386 in the body 368 and matching holes 388 in the heel cover 384. Screws 392 are also shown as passing through forward holes 390 and through standing spacers mounted in vertical recesses 394 in the heel piece body 368. Each of the screws 392 is affixed to the ski.

The entire binding apparatus uses a variety of materials. Thin load bearing parts may be made of stainless steel, hardened steel, strong aluminum alloys and the like. Slidable parts with lower applied loads may be formed of hard, high strength, plastic materials, thus reducing the overall weight.

The binding of this invention combines the best aspects of telemark skiing, the ultra safe state-of-the-art method of release adopted by the alpine skiing industry, and the edge-holding power of an alpine touring system into a single binding design, or "hybridization".

The ski binding described herein is designed to accomplish and exceed the two main objectives cited above with a radically different design concept. It is the ultimate telemark skiing system and the lightest, most efficient alpine touring system available. Unlike all other telemark systems, the edge control capability of this binding is not dependent on the torsional stiffness of the flexible part of the boot's sole. The fundamental flaw of the conventional telemark ski system available today is its dependency on the flexible part of the boot for its torsional stability. The instability associated with telemark systems is a result of the three-pin binding, the standard binding for all telemark systems commercially available. The ski industry has improved the stiffness of the boot's upper with the placement of reinforcing plastic inserts around the cuff and ankle in an attempt to improve the structural support of the skier and torsional stiffness of the overall system but have not dealt with the fundamental problems of instability that stem from the continued use of the three-pin binding.

In this invention, the idea of three-pin binding was discarded completely. The new designed binding makes the link between the ski and the elements of torsional stability in the foundation of the classical telemark boot without disrupting the desirable aspects of the sport of telemarking. This binding system combines the high level of performance of alpine skiing with the efficiency and mobility of a cross-country skiing into an ultra light-weight binding system capable of performing high performance, state-of-the-art telemark turns.

The system of this invention when used with a flexible-toed boot allows the skier to execute a proper high performance telemark turn, using the ball of the foot, while at the same time providing the ability to cross-country ski.

The binding system disclosed herein releases transversely at the toe and the method of release used allows the boot release motion to impend when an impacting force is great enough, but not completely release the boot if the force at this level is not sustained. As the toe of the boot is moved toward a release point, the resistance to release increases. In this case, the binding returns the boot to its original stationary position, thereby preventing any tendency for "pre-release". This type of toe release is considered to be the state-of-the-art method of release and has become the standard of the ski industry. Other types of alpine touring bindings do pre-release creating hazards for the skier. In order to prevent pre-release it is necessary to adjust those bindings so that a greater force is required to initiate release. This has the effect of increasing the chance for skier injury.

The light weight of the binding system of this invention is a particular advantage to alpine touring.

Reference herein to the details of the illustrated embodiments is not intended to restrict the scope of the appended claims.

What is claimed:

1. A ski binding system for alternatively attaching one of a flexible, partially flexible and rigid boot to an elongate ski having a longitudinal axis, comprising:

a boot with a heel end and a toe end of a sole and upper for closing and supporting the heel, toe and ball of a skier's foot;

boot attachment means fixed to said sole at one of a location at said ball of a skier's foot and rearward of said ball of said skier's foot;

a base plate having forward and rear ends, said base plate comprising a boot platform releasably joined to said ski for safety release therefrom by excessive force between said boot and said ski;

pivotable attachment assembly means mounted to said base plate to secure and release said boot attachment means to said base plate, said attachment assembly means pivotable about a transverse axis and extendable for upward movement of said heel end and said boot attachment means relative to said base plate;

bail means to substantially restrict the transverse and upward movement of said toe end relative to said base plate; and means for releasably joining said forward and rear ends of said base plate to said ski whereby said safety release includes transverse release of said base plate forward end and upward release of said base plate rear end.

2. The ski binding system of claim 1, wherein said boot sole includes an opening therein, and said boot attachment means comprises:

at least one boot plate, each said boot plate including an elongate axle member spanning said opening in said boot sole in a transverse direction wherein a set of locking jaws of said attachment assembly means is inserted in said opening to intersect, grip and lock to said axle member for permitting said attachment assembly means to pivot about said transverse axle member, said pivoting in a vertical plane passing through said longitudinal axis of said ski while preventing torsional movement of said boot about an axis parallel said ski.

3. The ski binding system of claim 2, wherein said attachment assembly means in said base plate includes at least one set of said locking jaws lockable to said axle member, said set of locking jaws fixedly connected to the forward end of a guide means having its rear end pivotable about a first, normally fixed transverse axis and intermediately pivotably attached to a hinge means, said hinge means pivotable about a second fixed transverse axis, wherein the path of movement of said locking jaws from a lowermost to an uppermost position follows the path of movement of said boot attachment means as said boot is flexed upward from a lower position on said base plate.

4. The ski binding system of claim 3, wherein said guide means comprises an elongate guide bar having its rear end pivotably attached at a normally fixed point near the rear of said base plate and having its forward end slidable, and an elongate guide bar housing with a cylindrical bore therein, said forward end of said guide bar adapted to slide in said cylindrical bore along a uniform axis, and said guide bar housing communicating with said sets of locking jaws and pivotally attached to said hinge means.

5. The ski binding system of claim 2, wherein said elongate axle member is rotatable.

6. The ski binding system of claim 2, wherein said elongate axle member comprises an axle having a rotatable hollow roller mounted thereon and rigidly held by said boot plate.

7. The ski binding system of claim 1, wherein said boot attachment means is fixed to said sole at a location between about 25 to about 50 percent of the distance between said toe and said heel of said skier's foot.

8. The ski binding system of claim 1, wherein said boot attachment means is completely within said sole.

9. The ski binding system of claim 1, wherein said attachment assembly means includes at least one set of locking jaws removably lockable to said boot attachment means.

10. The ski binding system of claim 9, wherein each said set of locking jaws includes two stationary jaws and movably openable jaw therebetween and a spring-biased latch to lock said openable jaw.

11. The ski binding system of claim 10, wherein said movably openable jaw is opened pivotally and is spring-biased to an open position upon release of said biased latch to open said openable jaw.

12. The ski binding system of claim 10, further comprising an elongate opening means accessible to said skier for activating said spring-biased latch to open said openable jaw to a fully open position.

13. The ski binding system of claim 1, wherein said attachment assembly means includes means for biasing said boot heel to a lower position on said base plate while permitting said boot heel to be raised from said base plate against increasing pressure.

14. The ski binding system of claim 13, wherein said biasing means comprises a spring and a spring-actuated member which acts on a heel return cam surface pivotably hinged to said base plate, said spring increasingly compressed by said heel return cam surface as said boot heel is raised.

15. The ski binding system of claim 1, wherein said bail means comprises an elongate bail which overlies the forwardmost portion of said sole and is spring biased rearward to compensate for forward and backward movement of said boot.

16. The ski binding system of claim 15, wherein said bail comprises a rigid elongate member having ends pivotally attached to opposite sides of a rearwardly spring-biased member, side sections attached to said ends, and a straight front section connecting the forward ends of said side sections.

17. The ski binding system of claim 16, wherein said rearwardly spring-biased member comprises at least one slidable block communicating with a toe bail spring mounted on said base plate and connected to said bail ends.

18. The ski binding system of claim 1, wherein said means for releasably joining said forward end of said base plate to said ski comprises a set of transverse release rollers, each said roller having a circumferential groove and rotatably fixed to the forward end of said base plate, and a corresponding set of oppositely facing transverse release levers, each said lever pivotably joined to said ski and having insertion means for insertion in said groove, each said lever being spring-biased to apply inward and rearward directed forces against the corresponding roller insertion means to lock said insertion means of said opposed release levers into said grooves and against said rollers in a normal position, wherein said release levers provide gradually increasing inward force against one of said rollers as said rollers move transversely from said locked normal position, and said rollers finally release from said levers upon exertion of a preset transverse force on said base plate.

19. The ski binding system of claim 18, wherein said insertion means is inserted into said groove over about one-fourth of the perimeter thereof.

20. The ski binding system of claim 1, wherein said attachment assembly means comprises:

a transduction hinge having a forward end pivotably attached to said base plate;

a platform having its rear end pivotably attached to the rear end of said transduction hinge, and having said attachment means at its forward end;

a guide bar housing fixedly connected to said platform, said guide bar having a cylindrical longitudinal bore therethrough;

a guide bar passing through said cylindrical longitudinal bore for sliding passage therethrough, said guide bar having its rear end pivotally held in a spring-biased sleeve in a normal position along a stationary axis, wherein excess forward pressure by said skier's foot actuates said guide bar housing forward to motivate said guide bar forward of said normal position;

a forward release cam on said base plate and normally held by a spring-biased sleeve in a position against a rear ski-mounted forward release means for retaining said base plate releasably retained on said ski;

wherein said excess pressure moves said guide bar forward to compress said spring for moving said sleeve away from said cam to release said cam and base plate from said ski-mounted forward release means.

21. The ski binding system of claim 20, wherein said ski-mounted forward release means comprises a heel member mounted on said ski and having a longitudinally slidable spring-biased stud block which communicates with said cam to retain said base plate on said ski, said stud block movable by said spring-biasing to compensate for ski surface lengthening from said flexure.

22. A system for snow skiing comprising:

a pair of elongated snow skis, each said ski having a front end and a rear end;

a pair of ski boots for a skier's feet, each said boot having a sold generally extending between a toe end and a heel end, said sole including an area rearward of said toe end supporting the ball of said skier's foot;

boot support means configured to be mounted on said skis, said boot support means including base plate means for each said ski, each said base plate means having a forward end and a rear end;

safety-release mounting means for mounting each said base plate means to said respective ski wherein excessive forces between said skier's foot and said ski disengages said base plate means from said ski;

toe attachment for attaching said toe end of each said boot to said forward end of said respective base plate means; and hinge means for pivotal attachment of each said boot to respective said base plate means, each said hinge means having a lower end fixedly pivotably attached to said base plate means and an upper end removably pivotably attached to said boot sole, wherein each said sole area rearward of said toe end may flex freely and is guidably movable upwardly from said base plate means for free-heel skiing.

23. A ski binding system for attaching a boot to an elongate ski, with longitudinal axis, comprising:

a base plate having forward and rear ends, said base plate releasably joined to the upper surface of a ski for safety release therefrom by excessive force between said boot and said ski while remaining attached to said boot;

pivotable attachment assembly means mounted to said base plate and pivotably attachable to said boot at one of a location at said ball of a skier's foot and rearward thereof, forward of the heel of said foot, to selectively secure and release said boot relative to said base plate, said attachment assembly means pivotable about a transverse axis and extendable for downwardly biased upward movement of said boot rearward of the boot toe end relative to said base plate;

bail means to restrict the transverse and upward movement of said toe end relative to said base plate; and means for releasably joining said forward and rear ends of said base plate to said ski whereby said base plate forward end is released transversely from said ski and said base plate rear end is released upwardly from said ski.

* * * * *